United States Patent [19]

Redner

[11] 3,970,315

[45] July 20, 1976

[54] FORTUNE TELLING GAME

[75] Inventor: Sheldon Redner, New York, N.Y.

[73] Assignee: Stephen Rothfeld, New York, N.Y.

[22] Filed: Jan. 24, 1975

[21] Appl. No.: 543,833

[52] U.S. Cl. ..... 273/161; 273/135 AC

[51] Int. Cl.[2] ..... A63F 9/18

[58] Field of Search .. 273/135 R, 135 AC, 135 AA, 273/134 AD, 134 C, 161, 139

[56] References Cited

UNITED STATES PATENTS

| | | | |
|---|---|---|---|
| 2,557,400 | 6/1951 | Van Asten | 273/161 |
| 3,603,593 | 9/1971 | Chew | 273/161 |
| 3,796,432 | 3/1974 | Beakley | 273/134 C |
| 3,801,106 | 4/1974 | Milton | 273/161 |
| 3,892,409 | 7/1975 | Herbert, Jr. | 273/135 AC |

*Primary Examiner*—Anton O. Oechsle

*Attorney, Agent, or Firm*—Natter & Natter

[57] ABSTRACT

A fortune telling game having an astrology board defining a plurality of zodiac stations containing horoscopic intelligence including indexing tokens bearing interrelated data and positionable over the zodiac stations. In accordance with the game instructions, certain of the tokens are removed from the zodiac stations to expose the written intelligence which is then subject to self interpretation in forecasting future events for amusement purposes and for giving personal advice and guidance.

5 Claims, 3 Drawing Figures

FORTUNE TELLING GAME

BACKGROUND OF THE INVENTION

1. Field of the Invention

The invention relates generally to a fortune telling device and especially to a game having an astrology board containing horoscopic intelligence.

In particular, the fortune telling apparatus of this invention concerns the use of indexing tokens in conjunction with an astrology board for locating and interpreting astrologic readings.

2. Description of the Prior Art

Astrology is an ancient science which seeks to understand the planetary forces and the influences they exert. Although previous devices have been developed concerning principles of astrology for determining individual horoscopes, these prior art astrological devices generally involve the use of spinners, charts, or cards and frequently include complicated instructions and require rather detailed analysis for interpretation.

Previously patented devices for foretelling future events which have boards and accessory cards, such as shown in U.S. Pat. Nos. 3,801,106 or 2,557,400, do not encompass the fortune telling concept as related to astrology. In contrast, the present invention places particular significance on the player's birth sign and incorporates this into the playing procedure and also into the interpretative connotations that are applied to the readings.

A disadvantage, therefore, of the prior art devices is that the player can only assume that the placement of the cards and meanings to be applied are dependent solely upon fortuitous circumstances, whereas the present invention affords one the opportunity to apply principles from the science of astrology. Although astrologic devices have been known, such as that illustrated in U.S. Pat. No. 3,355,822, these devices generally employ selective plaques of astrologic intelligence and effect particular readings with the use of rotary discs or spinners. Other astrologic kits employ the use of cards and/or charts. A shortcoming of these types of astrologic devices is that one readily loses interest and further the interpretation of the message frequently becomes quite involved and rather intricate.

The fortune telling game of this invention utilizes a board and associated tokens or cards. The effect of shuffling the cards and the placement thereof on the board adds to the excitement and generates interest, and thus provides a more enjoyable form of entertainment. Further, the instructions used are relatively uncomplicated and the players can readily add their own modifications to the rules of play.

BRIEF SUMMARY OF THE INVENTION

The astrological game apparatus of this invention is intended for general entertainment and amusement purposes as well as being applicable for personal guidance and fortune telling. The apparatus includes an astrology board having zodiac stations containing horoscopic intelligence. Indexing tokens or accessory cards are adapted for cooperative use with the zodiac board and for compatible placement over zodiac stations. The accessory cards provide an indexing system for determining the selective removal of certain of the cards in accordance with the instructions to thereby expose particular horoscopic intelligence on the board. The intelligence is in the form of key words and is used to form the basis for self interpreted messages. The words are read and given particular importance as in a prescribed manner indicated and are further dependent on the zodiac sign under which the person was born.

The representations appearing on the astrology board in the zodiac stations and on the indexing cards can thus be construed as a stimulus or influence in making personal decisions, in providing advice and for anticipating future events. The fortune telling game of this invention will thus enable the user to obtain a personal horoscope.

A feature of this invention is that no specialized knowledge in the field of astrology or the need for involved instructional materials are required for utilizing the apparatus.

Another feature of this invention is the relative simplicity of the game apparatus. Accordingly, use of the astrology board and the indexing cards can be readily acquired and will provide an interesting form of entertainment.

Having thus summarized the invention, it will be seen that an object thereof is to provide a fortune telling game apparatus of the general character described herein which is not subject to the disadvantages of the prior art.

Specifically, it is an object of the instant invention to provide a fortune telling game apparatus having an astrology board and accessory indexing cards.

Another object of this invention is to provide a fortune telling game apparatus having zodiac stations containing written intelligence and providing key words forming the basis for self interpretive messages.

The above and other objects, features and advantages of this invention will be apparent from the following description of the preferred embodiment when considered in connection with the accompanying drawings.

BRIEF DESCRIPTION OF THE DRAWINGS

In the accompanying drawings in which are shown some of the possible embodiments of the invention.

DETAILED DESCRIPTION OF THE INVENTION

Figure 1A:
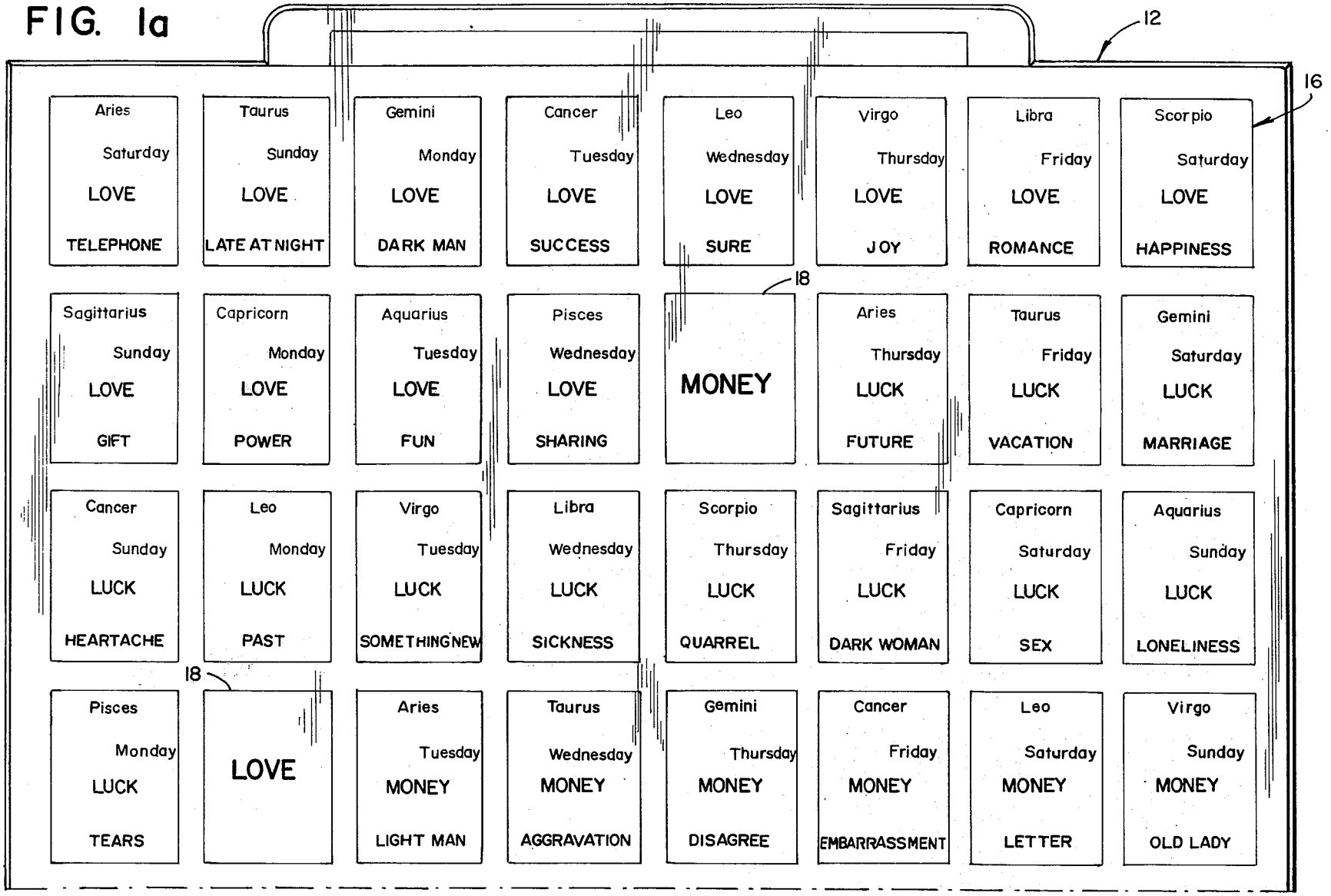
FIG. 1*a* is a plan view of the upper half of the astrology board of this invention and shows zodiac stations and horoscopic intelligence contained therein with each of the stations being denoted by the name of one of 12 zodiac signs except for two special stations being identified only by a key word contained therein.

Referring now in detail to the drawings, the fortune telling game apparatus of this invention is comprised of an astrology board 12 and of a plurality of indexing tokens or accessory indexing cards 14 for cooperative use with the board 12. As shown in the preferred embodiment of the invention illustrated in FIGS. 1*a* and 1*b*, the astrology board 12 consists of a smooth planar surface having markings on one face thereof which define a plurality of uniform spaces or rectangular spots being designated as zodiac stations 16. The board 12 is preferably fabricated from a stiff paper, pasteboard, cardboard or like material, which has been laminated as with a transparent plastic film to provide a durable surface. A flexible hinge section (not shown) can also be provided passing transversely through the board 12 so as to permit folding for compact storage when not in use.

The zodiac stations 16, as shown, are arranged in a pattern having an equal number of eight columns and rows with equally sized and evenly spaced boxes or rectangular spots thus defining the situs of the zodiac stations 16. A total of 64 stations will therefore be presented; it should be understood, however, that the number of stations and their arrangement can be modified within the scope of this invention.

The 12 known zodiac constellations or divisions, Aquarius, Pisces, Aries, Taurus, Gemini, Cancer, Leo, Virgo, Libra, Scorpio, Sagittarius, and Capricorn, and their respective signs and symbols as well as the dates when the apparent path of the sun enters the imaginary celestial or planetary belt, form an integral part of the game apparatus, and information can therefore be denoted as on board 12, although not shown in the drawing, to serve as a birth date guide if the player does not know his zodiac sign.

Figure 1B:
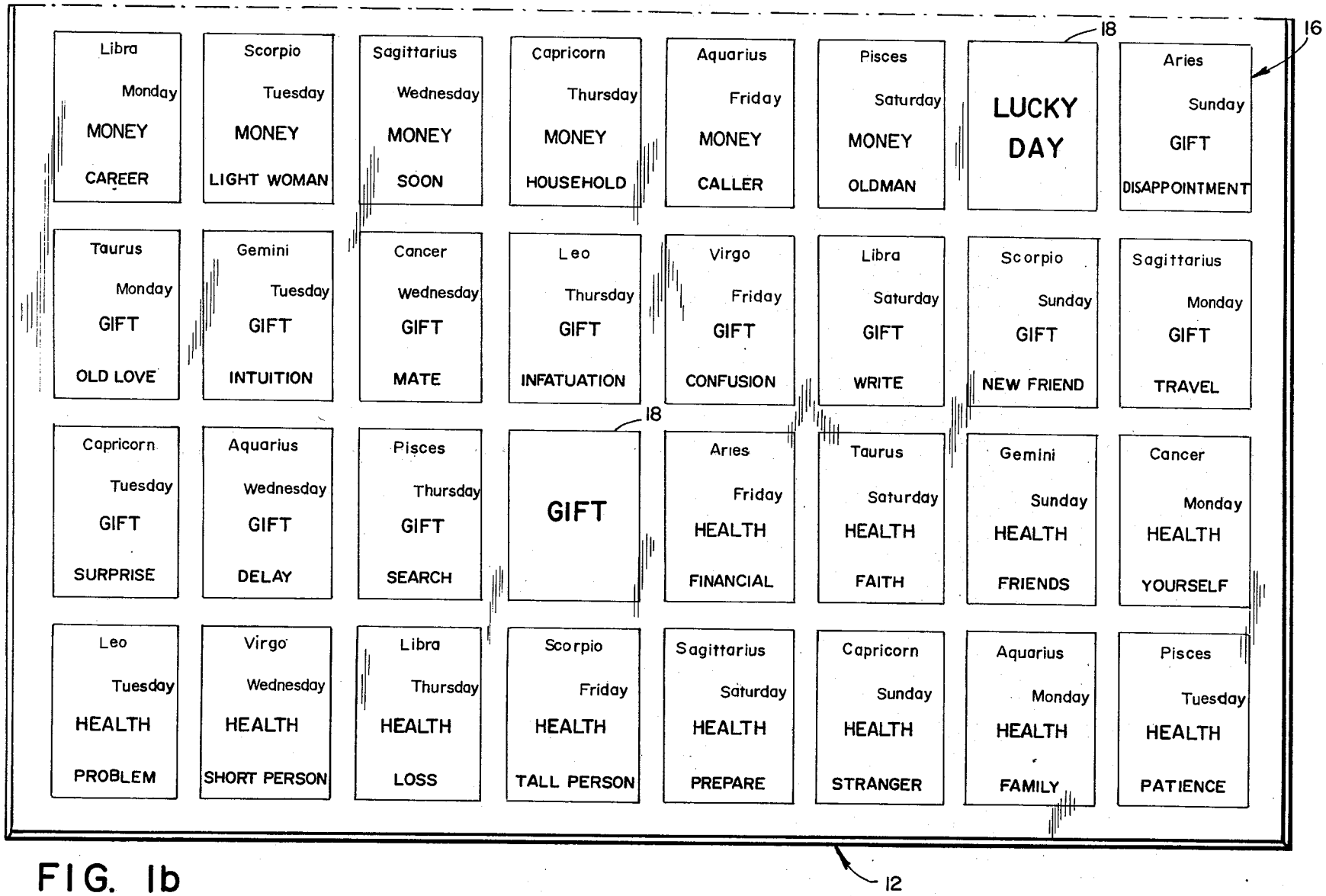
FIG. 1*b* is a plan view of the lower half of the astrology board of this invention and shows zodiac stations and horoscopic intelligence contained therein with each of the stations being denoted by the name of one of 12 zodiac signs except for two special zodiac stations being identified only by a key word contained therein.

The pattern of rectangular spots as illustrated in FIGS. 1*a* and 1*b* delineate five distinct series of zodiac stations from right to left and top to bottom on board 12. Each series of twelve stations is separately denoted by having a common primary key word.

The embodiment illustrated utilizes five primary key words: "Love," "Luck" or "Lucky Day," "Money," "Gift," and "Health." These words appear prominently displaced centrally within the various zodiac stations and appear in the largest type size letters used in printing of the message intelligence. The twelve zodiac names, and alternatively corresponding zodiac signs and symbols associated with the particular names, appear in each of the stations of the series. Further, the stations can be color tinted in a specific color designated for each of the 12 zodiac names. Between each of the five aforementioned series is a special zodiac station 18 containing a primary key word, however this station bears no zodiac name, sign or symbol. Further indicia printed within the five series of zodiac stations include horoscopic message intelligence denoted as time intervals, such as days of the week, months, or years.

As shown on board 12, the first series of twelve zodiac stations contain the primary key word "Love." The second series of stations contain the word "Luck"; the word "Money" appears in the third series; the fourth series has the word "Gift" therein; and the word "Health" is embodied in the fifth series. It should be apparent that the appearance of each of the five key words occurs 12 times in the 60 stations. Since the special zodiac stations each contain one of four of the primary key words, "Money," "Lucky Day," "Gift" and "Love", these four key words thus appear in an additional occurrence on the board. The key words were carefully selected for the wide latitude of suggestive meanings available for formulating messages in accordance with the game instructions.

A schedule of time periods such as days of the week are also placed within the aforementioned 60 zodiac stations. The present version of the board shows the seven days of the week with one day each assigned to each of the zodiac stations with the exception of the special zodiac stations 18. The date information thus provided is for the purpose of providing further significance to the message intelligence during interpretation thereof. In addition, 60 supplementary or secondary key words are included, one each, in the 60 zodiac stations of the five series, as is apparent in FIGS. 1*a* and 1*b*. These supplementary key words were also chosen because of their ability to complement or combine with and enhance the messages implied in the primary key words and therefore further lend direction and significance in interpretation of the message intelligence.

While the astrology board 12 provides a source of message intelligence, the selection and determination of the order in which this intelligence is to be read and interpreted is dependent on the indexing tokens or accessory indexing cards 14 and the random manner in which the placement of these cards 14 fall on the various zodiac station 16. The indexing cards 14 have identifiying data for indicating or determining the selection of certain of the cards 14 for removal. The cards 14 further contain information interrelated to the interpretive meaning of the message intelligence of the board 12.

The number of indexing cards 14 is equal to the number of stations 16 and a total deck of 64 cards is therefore used in the present embodiment. The indexing cards 14 are preferably rectangular in shape for compatible positioning on the station locations and may be fabricated from a stiff paper, pasteboard, cardboard or like material can be laminated with a transparent plastic film for providing disability.

The deck of indexing cards 14 can be considered as comprised of multiple sets of 12 cards each with each of the 12 cards of a set being denoted by a distinct zodiac name and symbol on the card face. Additionally, the cards 14 may be color tinted using the same color as applied to the corresponding zodiac stations. The reverse side of the indexing cards bears no indicia. Further information in the form of a common primary key word also appears on each card set. A special indexing card 20 bearing no zodiac name or sign and corresponding to the special zodiac station is also utilized to complete the deck of 64 cards.

Figure 2:
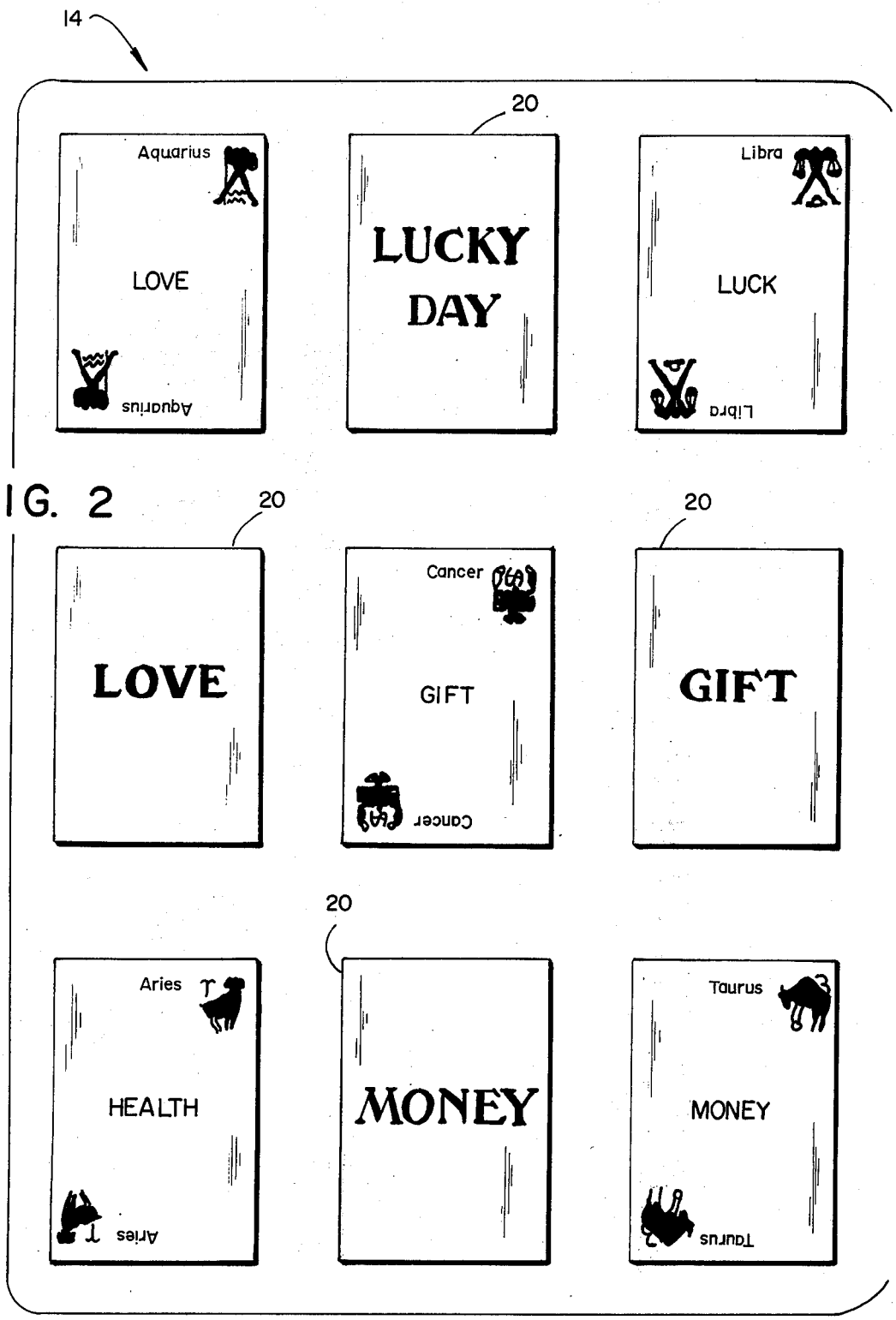
FIG. 2 is a plan view to a slightly enlarged scale showing typically nine of the 64 indexing cards adaptable for placement on the zodiac stations and illustrating one of the 12 cards in each of the five series of cards with each series containing one of five key words; also included are four additional special cards containing only a key word and no zodiac name and corresponding to the special zodiac stations.

FIG. 2 shows one card of each of the five sets and the four special cards.

In operation, the deck of 64 cards is well mixed or shuffled and then the cards are laid out on the board face up from left to right and top to bottom in sequence with each card covering a zodiac station. The player then determines from his birth date the particular zodiac name associated and then removes those five cards bearing his zodiac sign. If the card bearing the player's zodiac sign has been placed on a zodiac station bearing a matching zodiac sign, then in accordance with the instructions the key word on the card and the primary and secondary key word on the station should be used to form the basis for a self interpretive message when read along with the other intelligence found in the other four zodiac stations. However, if the indexing card exposes a zodiac station having matching zodiac sign and key word, then this is given particular attention and priority in formulating a message. Additional message intelligence for consideration include the day appearing in the zodiac station and its relation to the day of the reading as bearing on the accuracy of the message or it can otherwise be interpreted into the reading. With regard to the special zodiac stations, these primary key words are considered the basis for interpretation of the message when none of the cards fall on corresponding zodiac signs or corresponding key words.

The game can be played by one person or a multiple number of people. Additionally, it can be used for daily readings as well as for amusement and entertainment purposes.

The above cited embodiment is intended as exemplary, and while it has described the invention with a specific implementation thereof, other modifications and various changes might be made in the embodiment as above set forth and will be apparent to those skilled in the art. It should therefore be understood that all material described or shown in the accompanying drawings is to be interpreted as illusrative and not in a limiting sense.

Having thus described the invention, there is claimed as new and desired to be secured by Letters Patent:

1. A fortune telling board game apparatus for determining astrological readings based on the twelve zodiac signs, said game being suitable for amusement and entertainment purposes and comprising astrology board means for defining a uniform pattern of zodiac stations with each station bearing message intelligence, a plurality of accessory indexing cards, said cards being equal in number to the zodiac stations and adapted for compatible placement over each of the zodiac stations to conceal the message intelligence, selected indexing cards further containing identifying means for determining removal of cards from the board to expose message intelligence located on the respective zodiac stations, selected zodiac stations including identifying means, both identifying means being in the form of the twelve zodiac signs with the cards for removal bearing the zodiac sign corresponding to the player's astrological sign, said indexing cards further including information means conjunctive with the message intelligence and identifying means on those exposed zodiac stations for complemenatry intelligence conveyance to facilitate self interpretation in calculating readings of personal advice and guidance.

2. A fortune telling board game apparatus as claimed in claim 1 further including primary message intelligence within the zodiac stations, said primary intelligence being conjunctive with the information means on said indexing cards for formulating astrological readings.

3. A fortune telling board game apparatus as claimed in claim 2 wherein the information means on the accessory indexing cards includes primary key words, said primary key words having identical correspondence to the primary message intelligence on the zodiac stations.

4. A fortune telling board game apparatus as claimed in claim 3 further having secondary message intelligence within the selected zodiac stations, said secondary message intelligence being in the form of supplementary key words for furthering interpretation of the message intelligence and primary key words on the indexing cards.

5. A fortune telling board game apparatus as claimed in claim 2 wherein the accessory indexing cards are color-keyed to matching color zodiac stations, said matching color zodiac stations further bearing the same zodiac sign and containing primary message intelligence having identical correspondence to the primary key word on the respective indexing cards.

* * * * *